United States Patent [19]

Julovich

[11] Patent Number: 4,642,992

[45] Date of Patent: Feb. 17, 1987

[54] ENERGY-SAVING METHOD AND APPARATUS FOR AUTOMATICALLY CONTROLLING COOLING PUMPS OF STEAM POWER PLANTS

[76] Inventor: George C. Julovich, 3487 N. Vineyard Dr., LaPorte, Ind. 46350

[21] Appl. No.: 826,670

[22] Filed: Feb. 4, 1986

[51] Int. Cl.[4] ..... F01K 9/00

[52] U.S. Cl. ..... 60/661; 60/686; 165/40

[58] Field of Search ..... 60/660, 661, 686, 692; 165/34, 39, 40

[56] References Cited

U.S. PATENT DOCUMENTS 4,165,616 8/1979 Pierpoline ..... 60/686
4,600,049 7/1986 Nilsson ..... 165/39 X

FOREIGN PATENT DOCUMENTS 1987 1/1984 Japan ..... 165/39

*Primary Examiner*—Stephen F. Husar
*Attorney, Agent, or Firm*—Richard G. Kinney

[57] ABSTRACT

A system for energy-efficiently operating large capacity cooling pumps in a steam cycle electrical power generating plant which condenses steam using ambient water (e.g., from a lake, cooling tower, or stream) supplied by two or more large electrical motor-driven pumps is disclosed. The system sets reference values for condenser pressure, ambient water temperature, and feedwater flow or electric load, and when conditions change significantly, it cycles on or off one pump, measures and calculates energy efficiency, and depending upon those calculations, either recycles the pump off or on or maintains the status quo and updates the reference values for the plant, and automatically repeats the process upon another significant change of conditions. The system uses a digital computer, sensors, and interface units, for automatically controlling on or off the electric motors of the pumps.

11 Claims, 8 Drawing Figures

ENERGY-SAVING METHOD AND APPARATUS FOR AUTOMATICALLY CONTROLLING COOLING PUMPS OF STEAM POWER PLANTS

FIELD OF THE INVENTION

The present invention is directed to improvements in the operation of electric power generating plants of the type that use steam to drive the turbines and condense the spent steam by using ambient water supplied to the condenser by a number of pumps. More particularly, it is directed to an improved method and apparatus for automatically operating one or more of such pumps, so as to gain in overall energy efficiency.

BACKGROUND OF THE INVENTION

A majority of the large electric power plants in the United States are steam-cycle plants, wherein the spent steam is condensed by ambient water supplied from a source such as a river, cooling tower, lake, or pond. In the overwhelming majority of these plants, the water is supplied by up to four separate pumps operated in parallel, with each driven by its own high-horsepower electric motor. (For efficiency, such large motors and pumps are run at their optimum output and are not controlled or controllable as to output, except as to being either on or off.) Conventionally, at least two equal capacity pumps are employed, so that there will always be at least one in operating condition, and so that it is not necessary to completely shut down the plant in case of motor or pump breakdown.

Under certain conditions, it has been understood that not all of the pumps needed to be operated. For example, during winter in some areas, when the ambient water temperature was near freezing, the better operators would shut down one or more of the pumps, especially when the electrical generating load was low. Such actions have been heretofore largely based on subjective judgment of the staff operating the plant and thus prone to error, especially when conditions were far from clear. In these circumstances, the normal response of operators is to operate more pumps rather than less, as the operators are often busy with more immediate problems and more pressing duties in the operation of the power plant, and operating more pumps than needed is considered the lesser evil, in view of the possible loss of electrical generation that might result from operating less than was needed. Also, it is often not easy to predict the exact operating condition for reducing multi-pump operation, as this depends on factors such as scale build-up in condensers, cooling waterflow, tubesheet pluggage, and exhaust steam enthalpy, which will vary over time.

SUMMARY OF THE INVENTION

The present inventor has analyzed this energy efficiency situation of such electrical generating plants and discovered that significant savings can be made by operating fewer pumps more often than has been the past practice. To this end, he has developed a method and apparatus for automatically controlling such multi-pump plants, so as to more closely optimize the overall energy efficiency of the plant.

The invention, together with the advantages thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
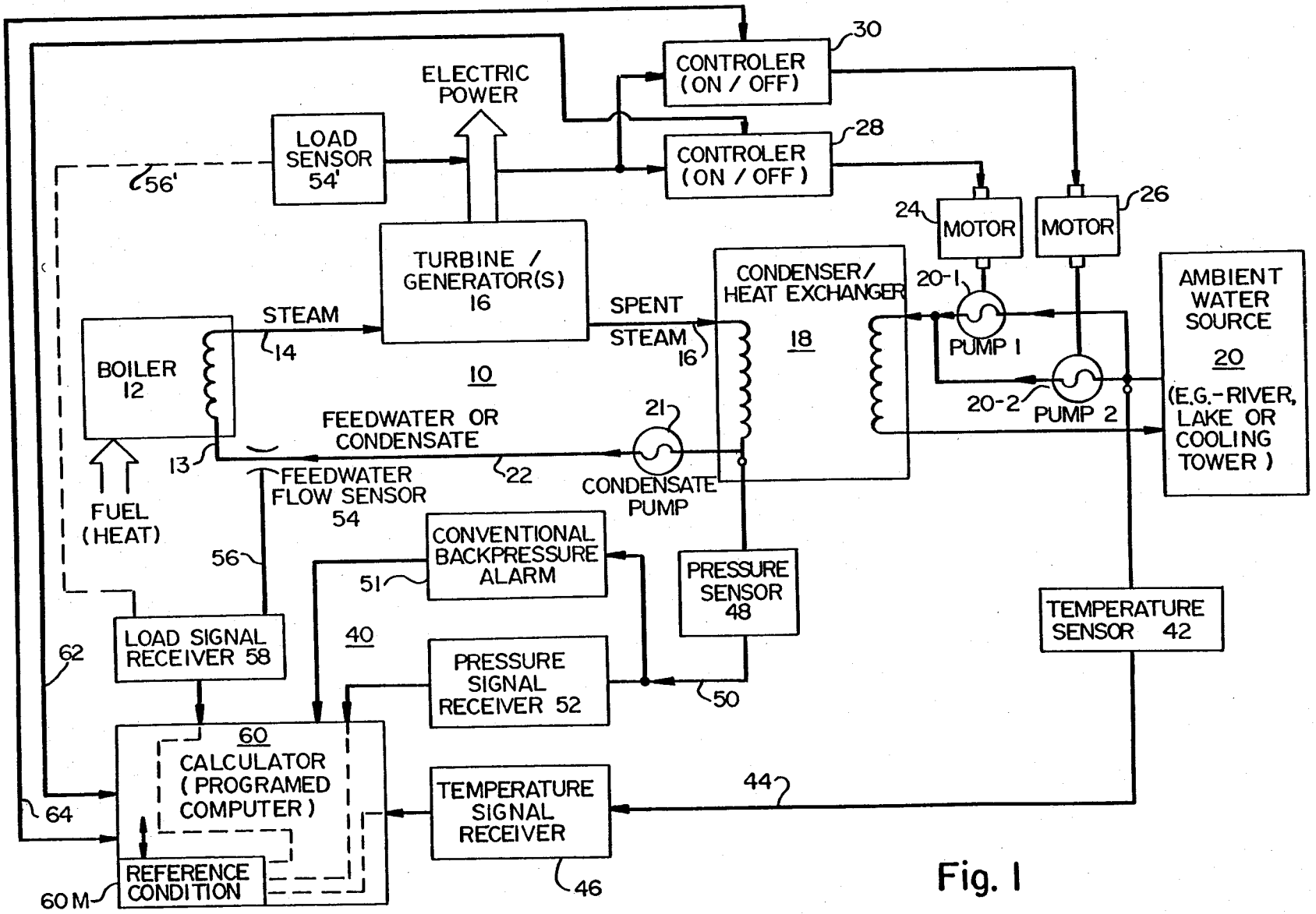
FIG. 1 is a schematic or flow diagram of a steam electric plant including control apparatus of the present invention.

Referring to FIG. 1, there is depicted in simplified form a steam electric power generating plant generally designated 10. The plant 10 includes a boiler 12 which takes in fuel or heat from any convenient conventional source, such as coal, oil, or nuclear power, and converts water received at 13 to steam at 14. This steam drives one or more turbines or generators 16 which produce electric power and conveniently deliver it to the power lines of a utility.

The spent steam is delivered at 16 to a condenser heat exchanger 18. The type of system 10 that we are here concerned with exchanges heat in exchanger 18 from the spent steam and a source of ambient water 20 such as a lake or river. The condensate is pumped by a pump 21 and delivered as indicated by line 22 back to the input 13 of the boiler. The condenser cooling water is fed by either or both of the pumps 20-1 and 20-2 to the exchanger 18 and then returned to the source 20. Such pumps 20-1 and 20-2 are conventionally of equal size and capacity.

The closed cycle as thus described and depicted may be entirely conventional and has been simplified for ease of understanding and description. In fact, such plants 10 are quite complex, having, for example, alternative pathways for condensate. However, they all do essentially function as so far described.

While we have depicted and will hereafter describe the invention in a plant 10 with two equal pumps 20-1, 20-2 (and a significant part of such plants do have only two such pumps), it should be understood that such plants may employ three or more such large-capacity pumps and that the invention may be applied to such plants as well. That is, the plant has a maximum number of pumps that can be operated and a minimum number. In the case of the plant 10, these are two and one.

As shown, the pumps 20-1, 20-2 are respectively driven by electric motors 24, 26 which are supplied with electric power through respective controllers 28 and 30. Such controllers essentially function as switches, either turning the motor on or off. In practice, either one or the other or both motors 24, 26 may be powered to operate either one or the other or both pumps 20-1, 20-2. These motors 24, 26 are conventionally high-powered motors (150–2000 kw) and are operated either "on" or "off" but not otherwise controlled. In conventional systems, the controllers 28, 30 are manually controlled from the operating station of the plant 10.

However, in accordance with the present invention, a system generally designated 40 is provided for automatically operating the controllers and, thus, the pumps in a manner as will now be explained. The system 40 includes a temperature sensor, indicated by 42, for sensing the temperature of the ambient water supplied by the source 20. The sensor 42 generates an electrical signal related to the sensed temperature and delivers via line 44 to a receiver 46. The system 40 also includes a sensor 48 for sensing the steam exhaust pressure of the condenser/heat exchanger 18 and developing an electrical signal related to it on line 50. This signal is received by a suitable receiver 52.

The system 40 also includes a load sensor 54 which senses the electric load carried by the generator 16 and delivers an electrical signal proportional to it on line 56 to a suitable receiver 58. Since feedwater flow is directly proportional to load, it is used as this sensor. (As an alternative, the load or electrical power output of the plant may be sensed as indicated by sensor 54' and fed via line 56' to the receiver 58. As feedwater flow and load are directly and linearly related, either signal would represent the load on the plant 10, at least for purposes of determining short-range changes in load.)

The outputs from the receivers 58, 52, and 46 are preferably digital signals and are fed to a calculator 60, which is preferably a programmed digital computer. The unit 60 produces command signals on its output lines 62, 64 which respectively control the controllers 28, 30.

The receivers 46, 52, and 58 may be part of the computer or else separate units for converting the signals on lines 44, 50, and 56 to digital signals if they are sent as conventional analogue signals. (One example of such an internal A to D device is currently offered by Computational System, Incorporated, of Knoxville, Tenn., under their trademark "Wavepak".) The sensors 54, 54' and 48 and 42 are often available to drive meters or other analogue displays in the operations room of the generating plant, and as such, it is a relatively simple operation to couple these signals into the system 40.

Figure 2:
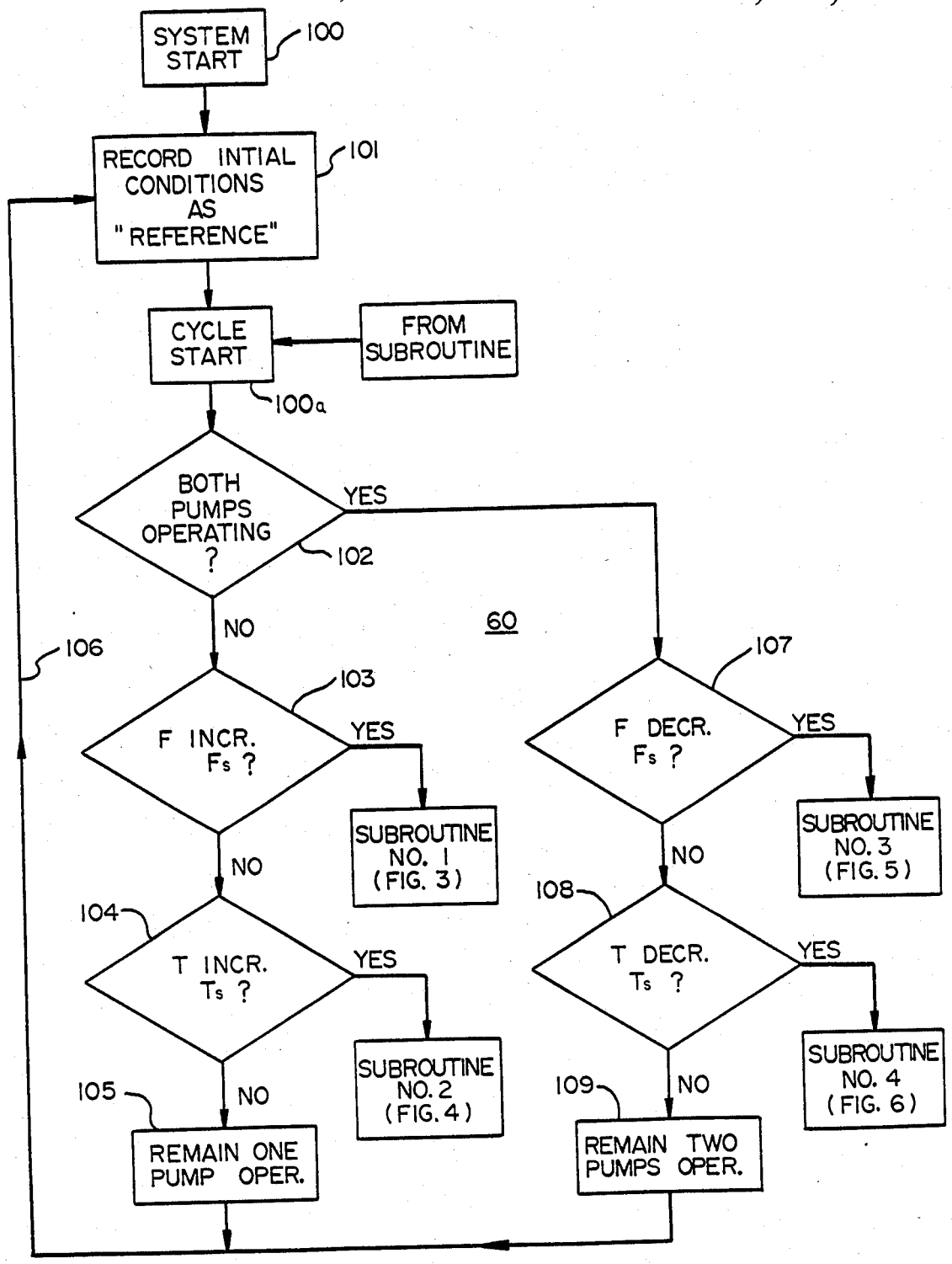
FIG. 2 is a computer flow chart of part of the program for use with the apparatus of FIG. 1.

Referring to FIG. 2, the overall operation of the calculator or computer 40 is depicted. Basically, the system senses and stores data, asks a series of questions of the plant 10, and based on the answers, either changes the state of the pumps or does not, and if it does, it then senses the effect of such change and decides on whether or not to restore the previous status or continue in the new mode of operation.

Upon initial system start, at step 100, the initial conditions of pressure, temperature, and load for an optimized operation are recorded as "reference conditions" in memory 60M of the computer 60 (FIG. 1). (This may be a manually-optimized condition or one devised by operating the system following the subroutines 1 or 3 of FIGS. 3 and 5, to be explained below.) The next step **100*a* after is cycle start. The calculator determines whether or not the maximum two pumps 20-1, 20-2 are operating or the minimum number is operating in step 102. If less than the maximum number of pumps are not operating, it moves to step 103, wherein it senses the change of the temperature (T) from reference level 60M and the change of the flow or load (F) from initial or reference level 60M. If the load (F) is increasing (over a certain set level such as 10% of reference level, Fr), it executes subroutine 1 shown in FIG. 3 and to be described below. This subroutine, when completed, may either cause the system 60 to change to add a pump—go to two pumps operating, or maintain the status quo—one-pump operation. In either case, it restarts the cycle at step 100*a***.

Figure 4:
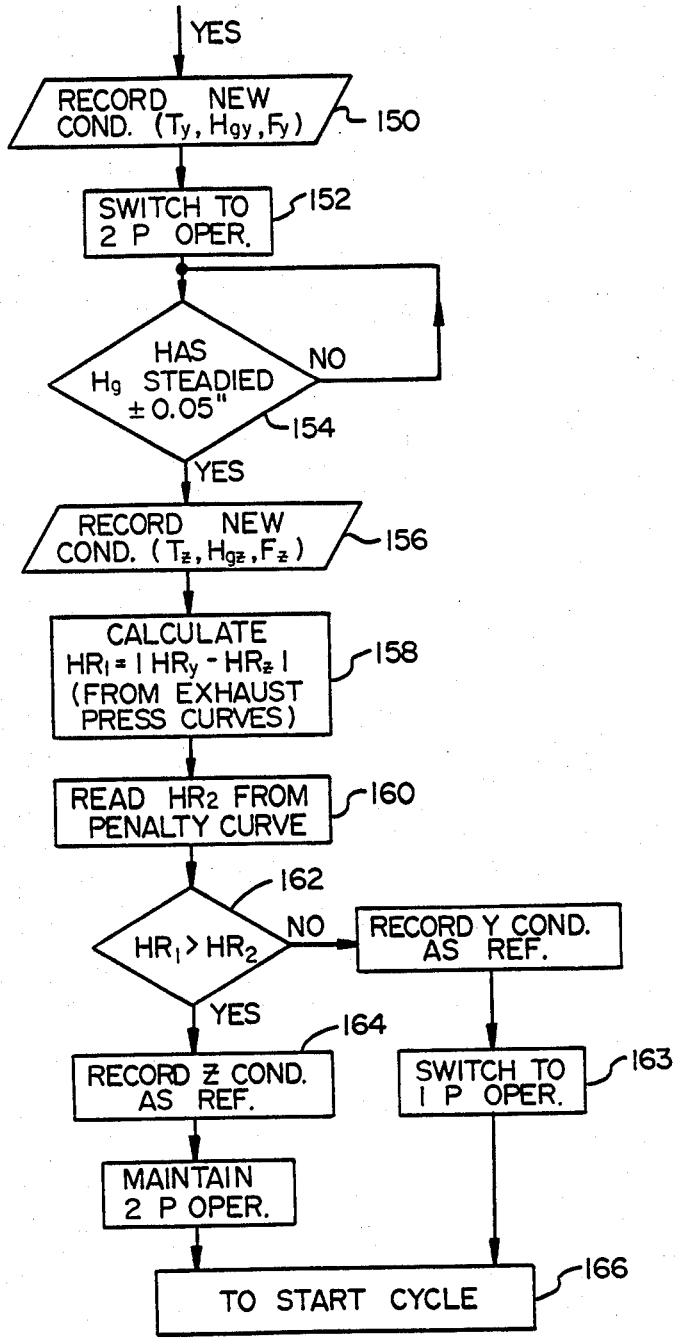

If the conditions at step 103 are such that the load (F) is not increasing; i.e., if the answer is "No," then the system asks in step 104 the question, "Has the temperature (T) increased (over a certain pre-selected level, Ts, over the reference temperature) and the load (F) constant?" If the answer is "Yes," the system executes a second subroutine (subroutine 2), which is shown in FIG. 4 and will be described in detail below. Again, the end result of subroutine 2 is either to change to two-pump operation or not, determine the effect and to restore one-pump operation or maintain operation at two pumps, and then restart at step **100*a*. If the answer to the question posed at step 104 is "No," then the system remains in one-pump operation, as indicated by the box 105, and the cycle is restarted as indicated by line 106**.

If the answer to the question posed at block 102 was "Yes," the system asks the further question, at block 107, of whether the load has increased a significant amount Fs (e.g., 10% of Fr—recorded reference load). If it has not, then the system 60 asks the further question, at block 108, of whether the temperature has decreased by a significant amount Ts (e.g., 5 degrees F.) from that of Tr; if "No," then the system is maintained at two-pump operation as indicated at block 109 and the cycle restarted.

Figure 5:
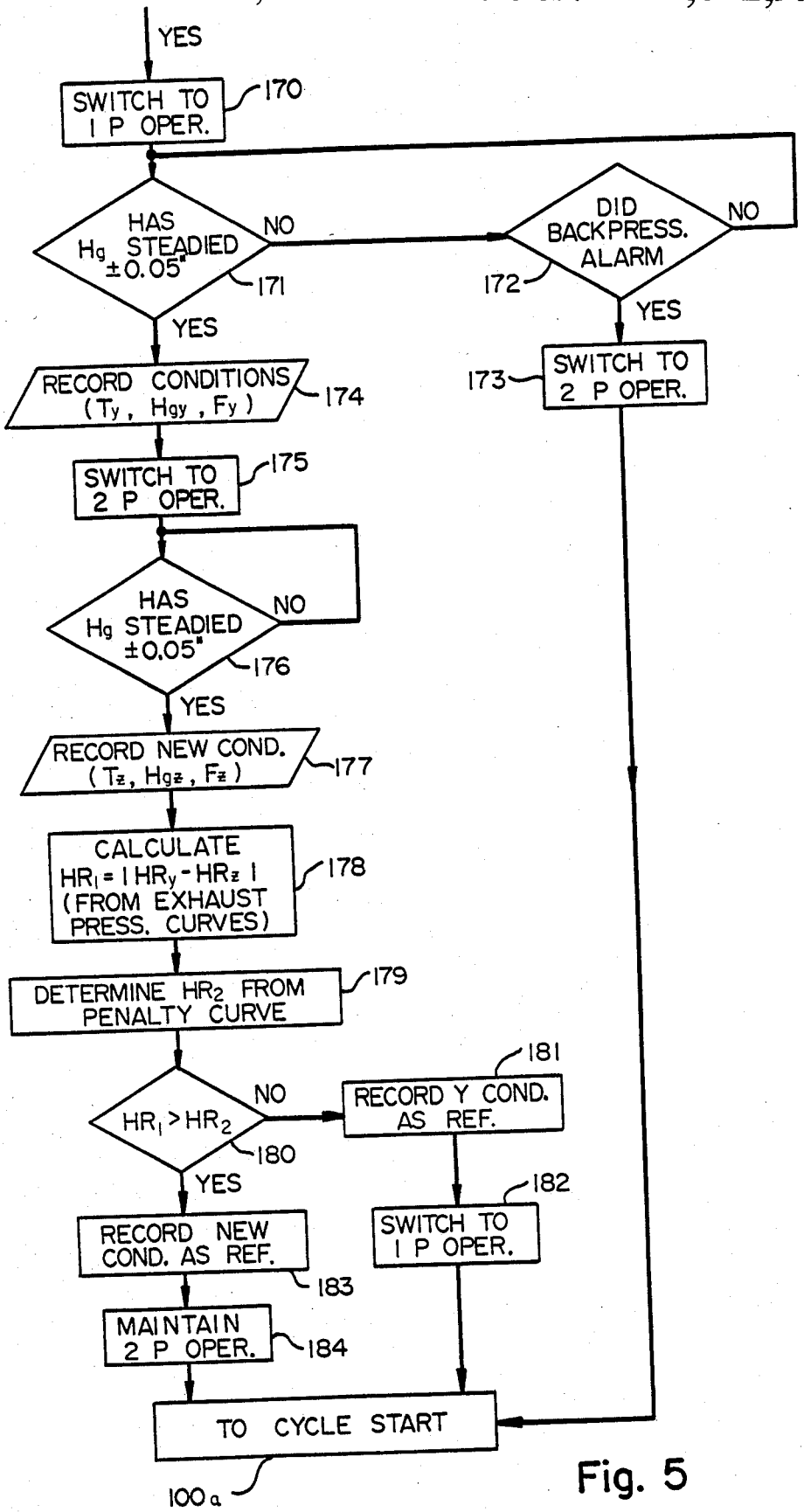
Figure 6:
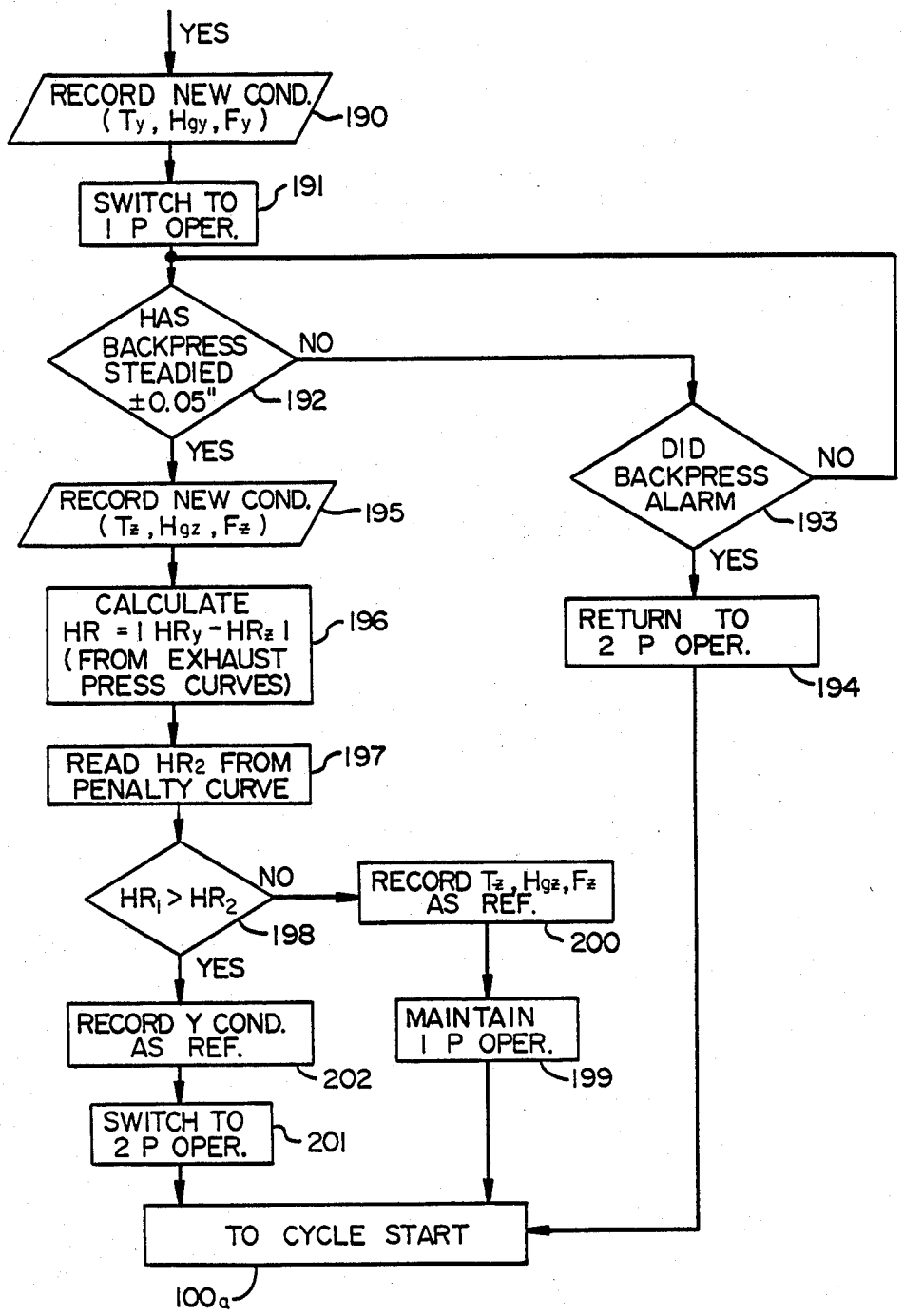

Should the answer to the question posed at logic block 107 be "Yes," then the subroutine of FIG. 5 is executed. And, if the answer at block 108 is "Yes," then the subroutine of FIG. 6 is executed. Both of these will be explained below. The end result of either subroutine is to either reset the pumps to one-pump operation and reset the reference values of the conditions 60M (FIG. 1), or to keep the system at two-pump operation. In either case, subroutines 3 and 4 restart the program cycle at block **100*a*** to recycle the process continuously.

Subroutine 1

Figure 3:
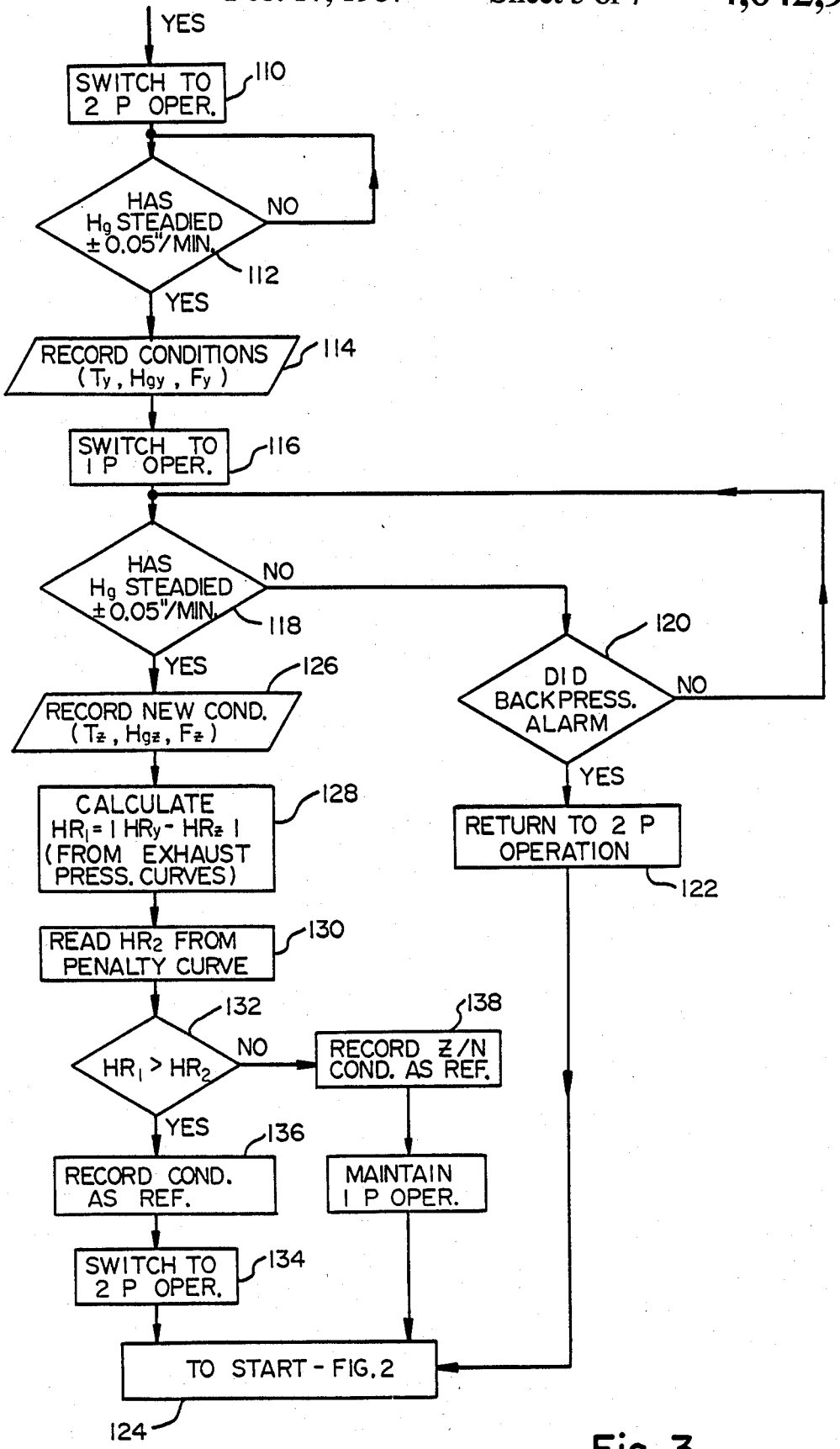
FIGS. 3 through 6 are flow charts of different subroutines of the computer flow diagram depicted in FIG. 2 and as indicated on that figure.

Referring now to FIG. 3, it can be seen that, if block 103 output is "Yes,"—that is, if the load has increased a significant amount Fs (e.g., 10% Fr) over the reference load Fr recorded in memory 60M, then the pump status is switched, as indicated by block 110, to two-pump operation; that is, signals are produced on lines 62, 64 (FIG. 1) to the controllers 28, 30, to insure that both motors 24 and 26 are turned on.

The system waits until the effect of operating the second pump has steadied; i.e., until the pressure sensed has steadied, for example, until within a plus or minus 0.05 inches of mercury within any minute. Until this is sensed at block 112, the system is kept at two-pump operation. When the output of block 112 switches to "Yes," a set of values of temperature, pressure, and load are temporarily recorded. The temporarily-recorded values are designated Ty, Hgy, Fy, in block 114.

At this point, the system switches to one-pump operation at block 116. The system then waits until the pressure has steadied (e.g., is not varying more than 0.05 inches of mercury per minute). Then, it asks the question, at block 118, "Has the pressure steadied?" If the answer is "No," it asks the further question, at block 120, of "Did back pressure alarm 51 sound?", and if it has, it immediately returns to two-pump operation and restarts the cycle (block 124). If not, then it returns to block 118 over line 126 and cycles until the output of block 118 is "Yes."

Figure 7:
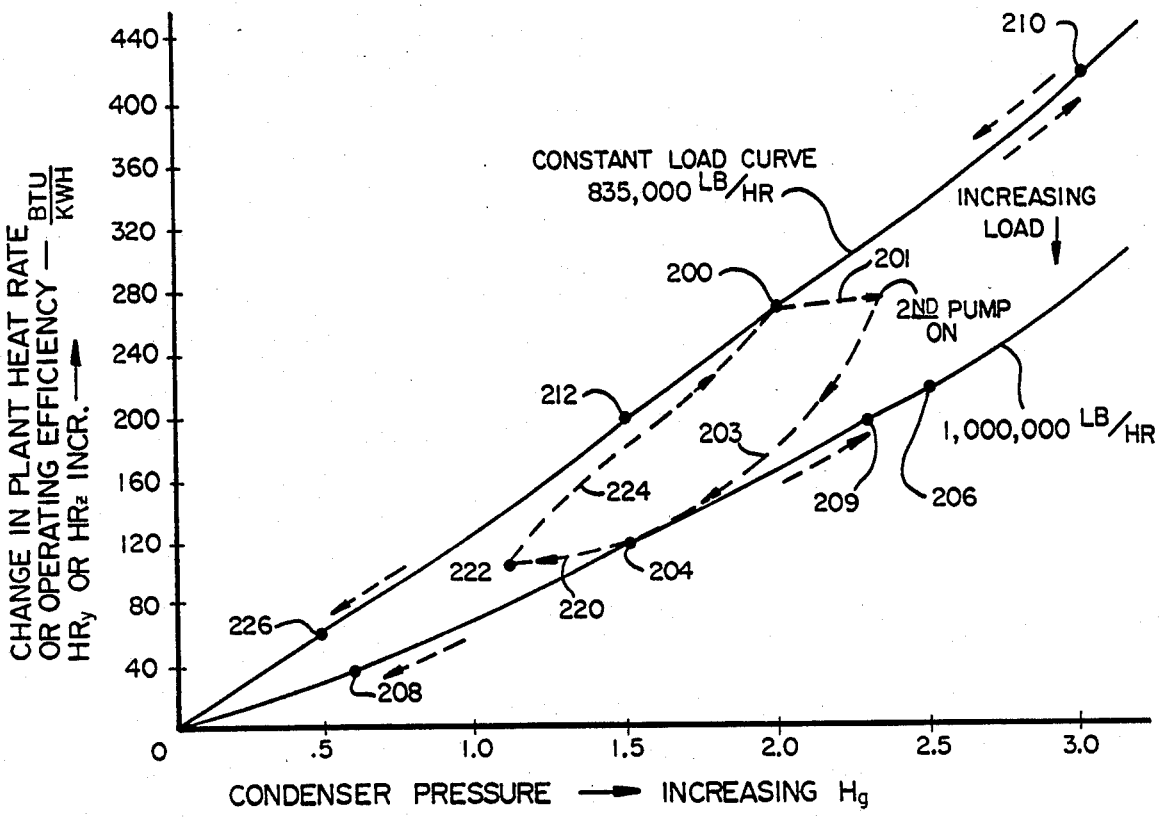
FIG. 7 is a graphical representation of change in heat rate, or plant operating efficiency versus condenser pressure, sometimes referred to as "Heat Rate Correction Curves for Exhaust Pressure", and the increase in heat rate when adding an additional pump versus load or feedwater flow, which graphs are useful in illustrating examples of the operation of the present invention.

At this time (block 126), a second set of new values of temperature, pressure, and load are recorded and heat rate (HR) is calculated for each set of values. Heat rate (HR) is defined as total heat input to boiler (BTU/HR) divided by electrical energy output (kw). The heat rate for a given plant 10 may be determined from the load chart instructions of that particular equipment, and a typical case is expressed in FIG. 7, wherein the heat rate is represented for various loads. (Such curves as in FIG. 7 are usually available in the information supplied by the engineers who designed and installed the plant 10.) For any given set of conditions T, F, and Hg, there is a corresponding HR value for the particular plant.

The system 60 then calculates at block 128 or derives the heat rates HRy and HRz for the conditions (Y and Z) recorded at blocks 114 and 126 and determining the absolute value of the differences (designated $HR_1$).

Figure 8:
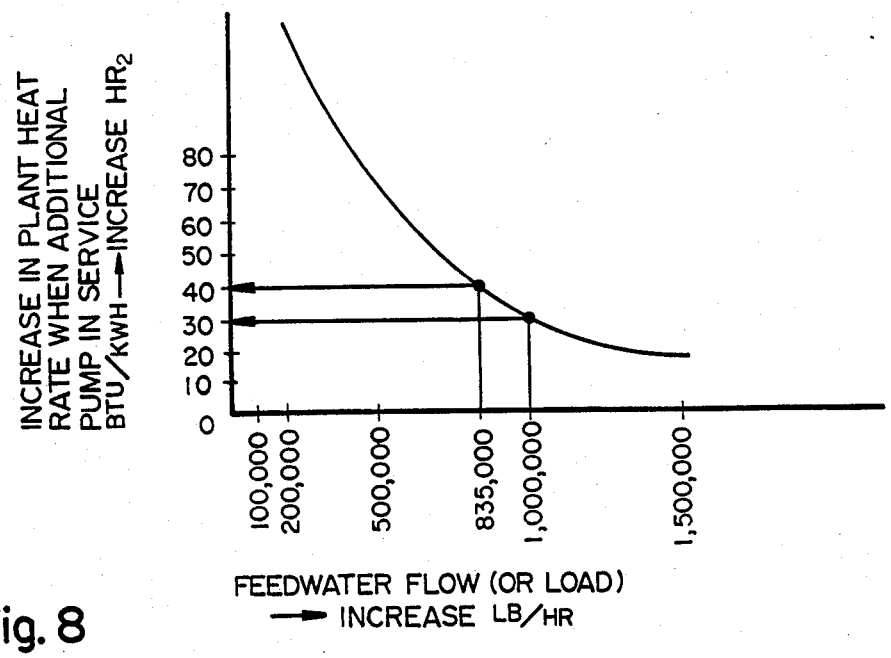
FIG. 8 is a graphical representation of the "penalty" in heat rate, i.e., the energy cost, of operating a second pump at various load conditions.

For a given load, the relationship between the heat rate for dual-pump versus single-pump operation is given by the curve in FIG. 8. With load Fy, this curve (or its equation) yields a value $HR_2$ which is the expected heat rate penalty for two-pump operation. $HR_2$ may be given by the equation:

$$HR_2 = \frac{(KW \text{ of Added Pump})(\text{Plant Heat Rate})}{KW \text{ of Total Plant Output}}$$

wherein the KW of Added Pump is a known constant, and the Plant Heat Rate and KW of Total Plant Output are variables, depending upon load or feedwater flow.

This value $HR_2$ is calculated or derived at step 130, and the system compares $HR_1$ with $HR_2$ and asks in block 132 the question: "Is $HR_1$ greater than $HR_2$?" If it is, then the system records the initial temporary values Ty, Hgy, and Fy as the reference values (block 136) in memory 60M, switches back to two-pump operation (block 134), and restarts the cycle at block 100*a* of FIG. 2.

If the answer to the question of block 132 is "No," the values Tz, Hgz and Fz are recorded in memory 60M as the reference values (block 138); one-pump operation is maintained and the cycle restarted (block 124).

Subroutine 2

Referring now to FIG. 4, subroutine 2 will be discussed. This subroutine is executed when one pump is in operation, load (F) has not received a significant amount but temperature (T) has increased a significant amount Tx over that Tr stored as the reference in the memory 60M. When this occurs, the current conditions of temperature Fy, pressure Hgy, and load Fy are stored in a temporary memory (step 150), and the pumps are switched to two-pump operation (step 152). As soon as the pressure has steadied (step 154), a second set of values Tz, Hgz and Fz are stored (step 156) in temporary memory, and HRy and HRz again calculated and $HR_1$, the absolute values of their difference calculated (step 158). The value of $HR_2$ for the load Fr is derived at step 160 and compared with $HR_1$ at step 162. If $HR_1$ is not greater, then "y" conditions are recorded as new "r" conditions (step 165), the pumps are returned to one-pump operation (step 163), and the cycle restarted (step 165). If the answer at block 162 is "Yes," then the values Tz, Hgz and Fz are substituted in memory 60M as the new reference values; (step 164) and two pumps are maintained in operation, as indicated by block 164*a*, and the cycle restarted (step 166).

Subroutine 3

Referring now to FIG. 5, subroutine 3, which is excutcd when the system 60 senses that the plant 10 has been in two-pump operation for a period of time, and the load F has decreased by a significant value Fs (e.g., 10%) from Fr.

This subroutine initially switches off one of the pumps 20-1, 20-2 (step 170) and asks the question, "Has Hg steadied?" (e.g., to ±0.05 inches Hg per minute) at step 171. If that has not occurred, it then asks whether the alarm 51 (FIG. 1) has sounded (step 172), and if it has, it switches to two-pump operation (step 173) and restarts the cycle at step 100*a* (FIG. 2). If not, it recycles between steps 171 and 172 until one or the other is "Yes." When the answer to step 171 is "Yes," a set of "y" conditions are recorded at step 174, and the pump motors are again turned on to two-pump operation (step 175). When the pressure has steadied (step 176), a set of "z" conditions are recorded (step 177) and then HRy and HRz are calculated (step 178) from the "y" and "z" determined using the relationships of FIG. 7 and $HR_1$ calculated. The value of $HR_2$ is next calculated or derived (step 179) from relatives of FIG. 8.

At this point, step 180, the system asks whether $HR_1$ is greater than $HR_2$, and if the answer is "No," then the "y" conditions are recorded (step 181) as a new set of reference conditions in memory 60M, and the plant returned to one-pump operation 182 and the cycle restarted (step 100*a* of FIG. 2).

If the answer to step 180 is "Yes," then the "z" conditions are recorded (step 183) in memory 60M and maintaining the two-pump operation (block 184), the cycle restarted at 100*a*.

Subroutine 4

When the system 60 (FIG. 2) senses that both pumps 20-1, 20-2 are operating, that the load F has not decreased by Fs but that the ambient water temperature T has decreased by a significant amount (e.g., 5 degrees F.), then it executes subroutine 4.

Referring to FIG. 6, this subroutine is there depicted. The first step 190 is to record (in temporary memory) the current conditions Ty, Hgy, and Fy, and then (block 191) switch to one-pump operation. The system then asks the question, "Has the backpressure steadied?" at block 192. (If not, it asks the further question, "Did backpressure alarm sound?" (block 193)). If "Yes," it returns to two-pump operation (step 194) and restarts the cycle. If "No," it returns to step 192.

When the output of step 192 is "Yes," another set of current conditions Tz, Hgz, and Fz are stored, step 195, and the system 60 calculates, step 196, the values of HRy and HRz and the value of $HR_1$, as was done before. The system then, block 197, determines $HR_2$ as before and asks the question, step 198, of whether or not $HR_1$ is greater than $HR_2$. If it is not, the system records (step 200) in memory 60M: Tz, Hgz, and Fz as the reference numbers Tr, Hgr, and Fr; maintains one-pump operation as indicated at block 199; and restarts the cycle. If the answer at step 198 is "Yes," then it records, step 202, Ty, Hgy, and Fy as the new reference values and switches, step 201, to two-pump operation and restarts the cycle.

When employed with a system having more than one pump beyond a minimum number of pumps (e.g., a three or four pump system with a minimum of one and a maximum of three or four), the system would work essentially as described but with movements to be made in steps. Thus, if operating at one pump and temperature or load increases significantly, the system would go to two pumps and, unless one pump was optional, then go to three pumps or until the maximum number is reached or a lesser number is determined to be optional.

EXAMPLES

While we have outlined the operation of the system 40, it may be illustrative to go through a few specific examples. Assume that with one-pump operation the initial reference values are Tr=80 degrees F., Hgr=2 inches, F=100,000 kw for a two-pump plant whose characteristics are as shown in the graphs of FIGS. 7 and 8.

Upon start-up of the system 40, these values are signalled to the computer 60 and, at step 101 of FIG. 2, recorded as the reference values, and the cycle is started. At step 102, it is determined that one pump is in operation, and, as the answer to the questions of block 103 and 104 are both "No," the system is recycled continuously until the answer to one of the questions 102, 103, and 104 changes.

Let us assume that, after some time of operation at the reference values, a power company dispatcher requires additional output from the plant 10: an increase from 100,000 kw (835,000 lb/hr) to 120,000 kw (1,000,000 lb/hr). The generator 16 and boiler 12 are controlled to increase the power output. FIG. 7 depicted the two load curves for this particular plant 10 of our example, with point 200 being the initial reference value. As more power is generated, the operating point passes through a series of points along path 201, with the condenser pressure increasing along with the power output.

When the load has increased about 10% (to 918,500 lb/hr), the answer to the question at step 103 (FIG. 2) changes to "Yes," and the system executes subroutine number 1 (FIG. 3) and switches to two-pump operation. The system remains in two-pump operation until the pressure (abscissa of FIG. 7) steadies. That is, until the answer to question at step 112 is "Yes."

In the graph of FIG. 7, the plant 10 undergoes a series of operations that follows the path 203 (increasing load until 1,000,000 lb/hr curve is reached and decreasing pressure in response to the extra cooling resulting from the second pump), reaching a new operating point 204, at which case, it steadies (Hg+0.05 per minute). At this point, the answer at step 112 is "Yes," and the system then (step 114) records the new conditions (Ty, Fy, Hgy). These are, in our example, 80 degrees; 1,000,000 lb/hr; and 1.5 inches.

Next, step 116 is executed, switching to one-pump operation. This causes the operating point to travel along the 1,000,000 lb/hr curve from point 204 to point 206.

As it moves along this path, subroutine number 1 cycles through step 120. (Unless an alarm sounds, whereupon it returns to two-pump operation.) When it steadies at point 206, step 126 is executed, recording Tz, Fz, and Hgz. In this example, these are 80; 1,000,000; and 2.5.

The computer computes HRy and HRz (step 128) [which are shown in FIG. 7 as 120 BTU/kwh and 220 BTU/kwh, respectively] and calculates $HR_1$, the absolute value of the difference (which is 100 BTU/kwh, also shown in FIG. 7). In step 130, the computer calculates (or derives from the relationship expressed in FIG. 8) $HR_2$, which is 30 BTU/kwh,—the cost in energy of operating the second pump. $HR_1$ and $HR_2$ are then compared (step 132), and in our example, as $HR_1$ is greater by 70 BTU/kwh, the answer to the question of step 132 is "Yes."

This means that the net gain in energy efficiency of operating the second pump is greater than its energy cost, and, therefore, it is more effective overall to operate both pumps.

Because of this, the system executes step 136, recording the "y" conditions as the new reference "r" values, and then in step 134, switches back to two-pump operation and restarts the cycle. This would cause the operating point to travel down the 1,000,000 lb/hr curve from point 206 back to 204. Assuming conditions remain the same for a period, the system of FIG. 2 would then continue to recycle, answering "Yes" to the questions of step 102 and "No" to the questions of blocks 107 and 108 for that period.

EXAMPLE 2

Second Subroutine

Let us assume that we are again operating at point 200 with one pump, and at the same initial condition of Tr=80 degrees F., Fr=835,000 lb/hr, Hgr=2 inches, and the water temperature increases from 80 degrees F. to 85 degrees F., with load conditions remaining the same. The increased temperature will cause the pressure to rise and the operating point to move along the 835,000 constant load curve of FIG. 7 from point 200 to point 210, at which point the answer to the question of block 104, flow diagram of FIG. 2, will change to "Yes," and the system 60 executes subroutine 2.

Referring to FIG. 4, this subroutine initially records the current condition as the "y" condition. That is, Ty=85 degrees F., Hgy=3 inches, and Fy=835,000 lb/hr. The subroutine then switches to two-pump operation (step 152), which has the effect of reducing the pressure and moving the operating point back down the 835,000 curve of FIG. 7, toward a point 212 wherein the conditions are Tz=85 degrees F., Hgz=1.5", and Fz=835,000. When the pressure has steadied (block 154), these conditions are recorded (block 156) and HRy, HRz, and $HR_1$ calculated (block 158). From the graph of FIG. 7, we can see that HRy is approximately 420 for point 210, and HRz is approximately 200 for point 212. The absolute value of the difference, or $HR_1$, is thus 220. The system then, in step 160, calculated the penalty, which from FIG. 8, yields a figure of 40 BTU/kwh.

As $HR_1$ is greater than $HR_2$, the answer to the question at block 162 is "Yes," and the system records (block 164) the "z" conditions as the new reference, or "r" conditions, and maintaining the two-pump operation, restarts the cycle (block 165).

EXAMPLE 3

Subroutine 3

As a third example, consider that the operating conditions remain at the conditions at the end of example 1. That is, the system is operating with two pumps at point 204 of FIG. 7, with T=80 degrees F., F=1,000,000, and Hg=1.5 inches. And further assume, with everything else constant, that the load is caused to decrease from 1,000,000 to 835,000.

Initially, the effect of this would be to cause the operating point to move along the path indicated by dashed line 220 until the power output is sensed to reach 900,000 lb/hr (i.e., 10% or 100,000 lb/hr less). At this point (point 222 in FIG. 7) the answer to the question of block 107 changes from "No" to "Yes," and subroutine 3 (FIG. 5) is executed.

Subroutine 3 initially switches to one-pump operation, causing the operating condition of the plant to move along curve 224 to point 200, at which point it steadies. At this stage, it reads the "y" conditions (step 174) and switches back to two-pump operation (step 175).

This causes the operating point to move to point 226, and as soon as it reaches a steady state (block 176), the "z" conditions are recorded (Tz=80, Fz=835,000, and Hgz=0.5) (step 177) and HRy and HRz calculated (step 178). From the graph of FIG. 7, we can see that these values are 270 for HRy and 60 for HRz, yielding (step 178) $HR_1=210$. As $HR_1$ is greater than $HR_2$, the two-pump operation would be maintained.

EXAMPLE 4

Subroutine 4

Assuming that the plant is operating at the conditions of point 204, with two pumps in operation, and with conditions otherwise steady, the temperature decreases by our trigger significant value of 5 degrees F. The operating point moves from 204 to 208, at which time the answer to the question of block 108 goes to "Yes," and subroutine 4 (FIG. 6) is executed.

This subroutine records the "y" conditions (Ty=75 degrees F., Hgy=0.6, Fy=1,000,0000) (step 190) and switches to one-pump operation (step 191). This causes the operating point to move along the 1,000,000 curve of FIG. 7 to point 209 (Tz=75 degrees F., Hgz=2.3, Fz=1,000,000) (step 195). After steady state conditions are reached (step 192), these volumes are recorded (step 195) and HRy and HRz calculated (HRy=40, HRz=200) and $HR_1$ derived ($HR_1=160$) (step 196), and $HR_2$ determined ($HR_2=30$, as can be seen from FIG. 8) (step 197). As $HR_1$ is greater than $HR_2$, the "y" values are recorded as new "r" values (step 202), and the more efficient operation is to switch to two-pump operation (as indicated by block 201).

The above examples are, of course, simplified. In the normal situation, more than one condition will be changing. Load may be increasing at the same time temperature is decreasing or vice-versa. However, these examples do illustrate the basic operation. It should now be appreciated that the system will more often optimize the efficiency of the plant 10 and will result in energy savings over the prior practices.

While one particular embodiment of the invention has been shown and described, it will be obvious to those skilled in the art that changes and modifications may be made without departing from the invention, and, therefore, the aim in the appended claims is to cover all such changes and modifications as fall within the true spirit and scope of the invention.

I claim:

1. In an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, the method of more optionally operating the plant, comprising the steps of:

(a) recording a set of reference values for at least temperature and load (Tr, Fr) for the number of pumps in initial operation;

(b) monitoring the current temperature and load (Ty, Fy) and, if either of these change significantly (increasing or decreasing), if not already at the end of the range in that direction, changing the number of pumps in steps, in the same direction of change (increasing or decreasing), and (c) calculating the net gain or loss in overall energy efficiency of each new pump added, until the end of the range is reached or a most efficient number of pumps is determined, and then operating at that number, while updating the reference values (Tr, Fr) to its values and returning to step (b).

2. In an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, apparatus for automatically more nearly optimizing the operating energy of the plant, by automatically controlling the number of pumps operated, depending upon the changing conditions of electric power output and ambient water temperature, from a set of referenced conditions of temperature and load, and for updating those reference conditions and using stored data comprising of the plant's heat rate characteristics;

means for sensing the temperature (T) of the ambient water and producing a digital signal indicative thereof;

means for sensing the condenser pressure (Hg) and developing a digital signal indicative thereof;

means for deriving an electric generating load (F) indicative digital signal;

means for sensing the operational status of the electric motors driving the pumps and producing digital signals representative of that status;

a digital computer for receiving said signals and for storing the reference values of temperature (Tr), pressure (Hgr), and load (Fr), and for monitoring the load (F) and temperature (T) signals and when one pump is in operation, and for responding in the following manners:

when less than the maximum number of pumps is being operated, and the load and/or temperature increases significantly from the reference levels:

(a) switching on one more pump;

(b) when the results of the operation of this pump have reached a steady state, recording the current load and temperature (Ty, Fy);

(c) calculating the difference in overall efficiency, and if the one more pump has not resulted in a gain, restoring the prior status and updating the reference values with that condition's values;

however, if a gain has resulted and the maximum number of pumps is not in operation, repeating steps (a) through (c);

when more than the minimum number of pumps is being operated, and the load and/or temperature decreases significantly from the reference level, (d) switching off one pump;

(e) when the results of the operation of this pump have reached a steady state, recording the current load and temperature (Ty, Fy);

(f) calculating the difference in overall efficiency, and if the one less pump has not resulted in a gain, restoring the prior status and updating the reference values with that condition's values; however, if a gain has resulted and the minimum number of pumps is not in operation, repeating steps (d) through (f).

3. The system of claim 2, wherein said digital computer calculates efficiencies by first calculating the difference in heat rate under the two states and then compares that with stored heat rate penalties values for the operation of an added pump.

4. The system of claim 3, wherein the difference between the minimum and maximum numbers of pumps is one.

5. The system of claim 4, wherein the minimum number of pumps is one, and the maximum number of pumps is two.

6. In an electric power generating plant of the type which employs steam to generate electricity, using a condenser which is cooled by being supplied with ambient water whose temperature may change over periods of time, and which water is supplied to the condenser by either one or two large-capacity pumps, which may operate in parallel and are driven by separately-controlled electric motors, a system for automatically controlling the number of pumps operated, depending upon the changing conditions of electric power output and ambient water temperature, from a set of referenced conditions of temperature and load, and for updating those reference conditions and using stored data comprising of the plant's heat rate characteristics;

means for sensing the temperature (T) of the ambient water and producing a digital signal indicative thereof;

means for sensing the condenser pressure (Hg) and developing a digital signal indicative thereof;

means for deriving an electric generating load (F) indicative digital signal;

means for sensing the operational status of the electric motors driving the pumps and producing digital signals representative of that status;

a digital computer for receiving said signals and for storing the reference values of temperature (Tr), pressure (Hgr), and load (Fr), and for monitoring the load (F) and temperature (T) signals and when one pump is in operation, and for responding in the following manners:

when one pump is operating, and the load and/or temperature increases by a pre-selected significant amount from the reference level, (a) switching to two-pump operation;

(b) when pressure has reached a steady state, recording the current conditions of temperature and load (Ty, Fy);

(c) switching to one-pump operation;

(d) after the pressure has reached a steady state, recording the new conditions of temperature and load;

(e) calculating gain or loss in the plant energy efficiency of the one-pump operation and reversing the two-pump operation using the stored data, and maintaining or switching into the more efficient operation, while updating the reference values to those corresponding to the efficiency status, or when two pumps are in operation, and the temperature or load decreases by a significant amount, (f) switching to one-pump operation, and (g) after pressure has reached a steady state, calculating where the plant overall efficiency increased or decreased relative to two-pump operation using the stored data, and maintaining or switching into the more efficient operation, while updating the reference values to those of the more efficient operation, wherein, at the completion of either manner of responding, the system will recycle itself to respond again as set forth above.

7. The system of claim 6, wherein said digital computer calculates efficiencies by calculating the difference in heat rate under the one and two pump operating conditions and compares that with the stored heat rate penalty value for the operation of the second pump.

8. In an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, the method of more optionally operating the plant, the process of, when less the maximum number of pumps is operating and the load increases over a pre-selected significant amount above an established reference value:

(a) recording the current conditions of temperature, load, and pressure (Ty, Fy, Hgy);

(b) turning on an additional pump;

(c) when the pressure has reached a steady state, recording the new conditions of temperature, load, and pressure (Tz, Fz, Hgz);

(d) calculating the heat rate difference ($HR_1$) between the first recorded conditions HRy) and the last recorded conditions (HRz);

(e) determining the penalty heat rate value ($HR_2$) for the added pump at these conditions, and (f) if the penalty heat rate value ($HR_2$) is less than that of the heat rate difference ($HR_1$), maintaining the added pump in operation, but, if it is greater, turning off the added pump, while updating the established referenced values with the conditions corresponding to the pump conditions decided upon.

9. The system of claim 8 in an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, the method of more optionally operating the plant, the process of, when less than the maximum number of pumps is operating and the temperature increases a pre-selected significant amount above an established reference value:

(a) turning on an additional pump;

(b) when the pressure has reached a steady state, recording the new conditions of temperature, load, and pressure (Tz, Fz, Hgz);

(c) calculating the heat rate difference ($HR_1$) between the first recorded conditions HRy) and the last recorded conditions (HRz);

(d) determining the penalty heat rate value ($HR_2$) for the added pump at these conditions, and (e) if the penalty heat rate value ($HR_2$) is less than that of the heat rate difference ($HR_1$), maintaining the added pump in operation, but, if it is greater, turning off the added pump, while updating the established referenced values with the conditions corresponding to the pump conditions decided upon.

10. The system of claim 9 in an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, the method of more optionally operating the plant, the process of, when more than the minimum number of pumps is operating and the load decreases over a pre-selected significant amount below an established reference value:

(a) turning off one pump;

(b) after the pressure has reached a steady state, recording the current conditions of temperature, load, and pressure (Ty, Fy, Hgy);

(c) turning on said one pump;

(d) after the pressure has reached a steady state, recording the new conditions of temperature, load, and pressure (Tz, Fz, Hgz);

(e) calculating the heat rate difference ($HR_1$) between the first recorded conditions HRy) and the last recorded conditions (HRz);

(f) determining the penalty heat rate value ($HR_2$) for the added pump at these conditions, and (g) if the penalty heat rate value ($HR_2$) is less than that of the heat rate difference ($HR_1$), maintaining the one pump on, but, if it is greater, turning off said one pump and updating the established reference values, with the conditions recorded that correspond to the pump conditions decided upon.

11. The system of claim 10 in an electric power generating plant of the type which employs steam to generate electricity, using a condenser which is cooled by being supplied with ambient water whose temperature (T) is subject to changes over time, and which water may be supplied to the condenser by a number of pumps operated in parallel, each pump driven by its own motor, and said plant being constructed to operate with over a range between a minimum and a maximum number of such pumps, the method of more optionally operating the plant, the process of, when more than the minimum number of pumps is operating and the temperature decreases over a pre-selected significant amount below an established reference value:

(a) recording the current conditions of pressure, load, and temperature (Ty, Hgy, Fy);

(b) turning off one pump;

(c) after the pressure has reached a steady state, recording the new conditions of temperature, load, and pressure (Tz, Fz, Hgz);

(d) calculating the heat rate difference ($HR_1$) between the first recorded conditions (HRy) and the last recorded conditions (HRz);

(e) determining the penalty heat rate value ($HR_2$) for the added pump at these conditions, and (f) if the penalty heat rate value ($HR_2$) is less than that of the heat rate difference ($HR_1$), maintaining the one pump on, but, if it is greater, turning off said one pump and updating the established reference values, with the conditions recorded that correspond to the pump conditions decided upon.

* * * * *

UNITED STATES PATENT OFFICE

CERTIFICATE OF CORRECTION

Patent No. 4,642,992 Dated February 17, 1987

Inventor(s) George C. Julovich

It is certified that error appears in the above-identified patent and that said Letters Patent are hereby corrected as shown below:

Column 7, line 54, after "Hg", change "+" to --±--.

Signed and Sealed this

Eleventh Day of August, 1987

*Attest:*

DONALD J. QUIGG

*Attesting Officer*

*Commissioner of Patents and Trademarks*